US005503432A

United States Patent [19]

Goode

[11] Patent Number: 5,503,432

[45] Date of Patent: Apr. 2, 1996

[54] TAPERED SKI POLE MADE OF THERMOPLASTIC MATERIAL

[76] Inventor: David P. Goode, 1997 Long Lake Shores Dr., Bloomfield Hills, Mich. 48013

[21] Appl. No.: 60,034

[22] Filed: May 10, 1993

Related U.S. Application Data

[63] Continuation-in-part of Ser. No. 826,734, Jan. 28, 1992, Pat. No. 5,265,911, which is a continuation-in-part of Ser. No. 448,306, Dec. 11, 1989, abandoned, which is a continuation-in-part of Ser. No. 296,222, Jan. 12, 1989, Pat. No. 5,024,866.

[51] Int. Cl.[6] ..... A63C 11/22

[52] U.S. Cl. ..... 280/819; 264/322

[58] Field of Search ..... 280/819; 428/68, 428/70; 425/407, 408, 423; 264/322

[56] References Cited

U.S. PATENT DOCUMENTS

| | | | |
|---|---|---|---|
| 3,204,974 | 9/1965 | McDonald | 280/819 |
| 4,106,777 | 8/1978 | Kim | 280/819 |
| 4,107,249 | 8/1978 | Murai et al. | 264/322 |
| 4,301,201 | 11/1981 | Stout | 280/819 |
| 5,024,866 | 6/1991 | Goode | 280/819 |
| 5,135,599 | 8/1992 | Martin et al. | 264/322 |

FOREIGN PATENT DOCUMENTS

| | | | |
|---|---|---|---|
| 2605581 | 8/1976 | Germany | 280/819 |
| 43-17827 | 7/1968 | Japan | 280/819 |
| 1135380 | 5/1989 | Japan | 280/819 |
| 69662 | 10/1945 | Norway | 280/819 |
| 242862 | 11/1946 | Switzerland | 280/819 |

*Primary Examiner*—Eric D. Culbreth
*Attorney, Agent, or Firm*—Young, MacFarlane & Wood

[57] ABSTRACT

An improved fiber/resin composite tapered ski pole shaft and a method for making it. The shaft is hollow and is formed from a fiber/resin composite in which the resin is a thermoplastic material capable of being reheated and reformed. A straight, non-tapered, preformed shaft is heated at the lower end until the thermoplastic resin becomes workable, and then pressure is applied to taper the lower end of the shaft toward the tip. The shaft is held at a constant length during the tapering step such that the displaced thermoplastic material increases the wall thickness of the lower end of the shaft uniformly toward the tip. The rate of taper can be such that the tip becomes solid.

24 Claims, 3 Drawing Sheets

22
C
34
32
18
B
26
24
12
A
28

26
18
24
12

36
38
22
35
35
18
37
24
12

35
39
35
39
35
35

14
20
12
10
18
16
22

TAPERED SKI POLE MADE OF THERMOPLASTIC MATERIAL

PRIOR APPLICATIONS

This is a continuation-in-part of U.S. Ser. No. 07/826,734, filed Jan. 28, 1992, now U.S. Pat. No. 5,265,911 which is a continuation-in-part of U.S. Ser. No. 448,306, filed Dec. 11, 1989 abandoned, which is a continuation-in-part of U.S. Ser. No. 296,222, filed Jan. 12, 1989, now U.S. Pat. No. 5,024, 866.

FIELD OF THE INVENTION

The present invention relates to the ski pole art, and more specifically to a fiber/resin composite ski pole having a tapered lowered end, as well as a method for making it.

BACKGROUND OF THE INVENTION

The longtime standard in the industry, the extruded, hollow, tapered aluminum ski pole, is rapidly being overtaken by ski poles having fiber-reinforced resin composite shafts. Fiber/resin composite shafts are lighter, stronger and more flexible than the standard aluminum ski poles. Samples of fiber/resin composite ski poles are shown in my U.S. Pat. No. 5,024,866 issued Jun. 18, 1991 and my co-pending U.S. application Ser. Nos. 826,734 filed Jan. 28, 1992; 562,317 filed Aug. 3, 1990 and 863,334 filed Apr. 2, 1992. The above patent and co-pending applications show a variety of methods and structures for achieving strong, lightweight, low-diameter, flexible ski pole shafts.

Although it is easier and less expensive to manufacture fiber/resin composite ski pole shafts in the form of straight-walled, cylindrical shafts, it is often desirable to have a finished shaft with a taper at the lower end, for both aesthetic and performance benefits. Composite pole shafts are usually formed with a hollow bore, for weight considerations and because they can be efficiently formed about some sort of mandrel. Unfortunately, prior art methods for tapering the lower end of a hollow composite ski pole shaft greatly weaken the lower end of the shaft in terms of tensile strength and resistance to crushing or breakage.

Co-pending U.S. Ser. No. 863,334 is directed in part to a fiber/resin composite ski pole shaft made from a thermosetting resin matrix and having a tapered, reinforced lower end. The inventive structure and method disclosed in that application is a marked improvement over prior art methods and apparatus for providing a tapered lower end in fiber/resin composite ski poles using thermosetting resin.

Composite ski poles made with thermosetting resin are difficult to shape or reform after the resin has set, since thermosetting resins are not capable of being resoftened by heating once hardened. In order to provide a taper in the lower end of the thermoset fiber/resin ski pole shaft, it is necessary to remove material from the outer wall at the lower end by grinding, milling or similar material-removing steps. There are two primary disadvantages inherent in such tapering operations with thermosetting poles: the grinding or milling procedure is a time-consuming and relatively expensive one; and, removal of material from the outer wall of the shaft at the lower end results in decreasing wall thickness and a correspondingly weaker shaft at the lower end.

To solve the problem created by the weakening of the lower end upon removal of the outer wall material, I invented the solution of replacing the lost wall thickness at the tapered lower end with a filler rod inserted in the hollow bore to mate therewith and internally replace the lost wall thickness. This has proven to be an effective, inexpensive, reliable structure and method for tapering the lower end in thermosetting fiber/resin composite ski poles while maintaining the strength and break-resistance of the shaft at the tapered lower end.

While the above-described structure and method of my co-pending application does not have any disadvantages, it is always desirable to find new and better ways to manufacture tapered composite ski pole shafts.

SUMMARY OF THE INVENTION

I have determined that the tapering of fiber/resin composite ski poles can be greatly simplified and improved by using a thermoplastic resin for the matrix of the composite shaft, rather than a thermosetting resin.

By using a thermoplastic resin, a performed, hollow, straight-walled ski pole shaft can be subsequently reformed to provide a taper at the lower end thereof by reheating and reshaping.

One method for making a ski pole shaft from thermoplastic resin comprises pultruding an array of continuous reinforcing fibers into a forming die. A fluid thermoplastic polymer is injected into the forming die. The thermoplastic polymer is hardened within the forming die resulting in a continuous pultruded ski pole shaft which is then cut into suitable lengths. The method may also include an anti-splinter means, such as a polyester veil, inserted with the reinforcing filaments into the forming die prior to the injection of the fluid thermoplastic polymer. Additionally, the anti-splinter means may be added after the ski pole shaft is formed.

The thermoplastic composite shaft may be easily tapered through a secondary forming operation. A tapering step may be introduced, wherein the ski pole shaft is placed in a heated forming die, which re-heats the thermoplastic polymeric material, allowing a taper to be formed on the end of the ski pole shaft. This reforming process is particularly advantageous when used with shafts of hollow construction. As the material at the end of shaft is compressed to the hollow center of the shaft during the reforming process, this reforming process results in a concentration of material at the end of the ski pole shaft, resulting in a uniform strength throughout the length of the shaft, as opposed to milling the shaft to achieve the taper, which causes a reduction in strength of the pole tip as a result of material loss.

Further, a step may be added to the second embodiment whereby the ski pole shaft may be reformed in a curved or bent fashion suitable for use as a high performance ski pole, such as those used for competitive ski racing. The thermoplastic polymeric material allows the pole shaft to be formed in any shape desired by each individual skier.

The tapering of the reheated lower end of the thermoplastic fiber/resin composite ski pole shaft involves the further inventive step of maintaining the length of the ski pole shaft constant while the taper is being formed. This results in an improved and novel structure at the tapered lower end of the reformed shaft, namely an integral, gradually increasing wall thickness toward the tip of the pole. By holding the length of the shaft constant when reforming the lower end into a taper, the wall material displaced by tapering simultaneously increases the wall thickness of the tapered lower end. Accordingly, as the taper of the pole increases toward the tip, both the outer and inner diameters of the hollow shaft decrease correspondingly. The ratio of the outer and inner diameters can be chosen to maintain the wall thickness of the tapered lower end equal to the wall thickness of the shaft in general, or it can be increased to make it even stronger. In fact, the increase can be such that the tapered lower end of the ski pole becomes solid at or near the tip.

In one embodiment of the invention the lower end of the hollow thermoplastic shaft is subjected to uniform circumferential pressure to achieve the desired taper. This can be accomplished with any of several methods, including a reheating/reforming die or a shrink tube method.

In another embodiment, the taper is formed in two steps, the first step involving a first flattening taper, and the pole then rotated 90° for a second and final pressure step to finish and round out the end taper.

In a further embodiment of the inventive tapering method, additional molten thermoplastic resin is injected onto the tapered lower end before or simultaneous with the final forming. This prevents problems with "dry fibers" protruding from the resin matrix at the tapered lower end, which can occur when the fiber/resin ratio is high. The addition of extra molten resin also maintains the temperature of the tapered lower end to keep it suitably soft for the remainder of the forming process. The same resin can be added, although I have found it particularly advantageous to inject molten resin having a higher melting point.

In another embodiment of the invention, the outer surface of the shaft at the tapered lower end can be formed during the tapering step to define a basket receiving portion or similar external structure.

The thermoplastic resin used can be any of a number of currently available materials including, but not limited to, polyethylene, ABS, polypropylene, nylon-based materials such as Monsanto's thermoplastic composite resin system known as Forlon™, and PEEK. The requirements for the resin are that it be thermoplastic, deformable within a suitable temperature range, and of a sufficient strength and flexural modulus when hardened to produce a strong, lightweight, break-resistant ski pole shaft. Other possible thermoplastic polymeric materials which can be used in the construction of the invention include: acrylics; polyetheretherketone, polyolefins; thermoplastic polyamide, polyesters, acrylonitrile-butadiene-styrene, polycarbonate, polyethersulfone and the like.

In a preferred embodiment either PEEK or Monsanto's Forlon® nylon resin is used. The use of the PEEK resin provides a shaft with optimal structural characteristics, while Monsanto's Forlon® is less expensive and provides comparable strength and flexibility.

A preferred thermoplastic pole shaft construction for use with the present invention exhibits an approximately 4:1 fiber/resin ratio with the fibers running longitudinally along the axis of the shaft. The fibers can comprise any of the commonly used reinforcing filaments such as glass, carbon or Kevlar.

In a most preferred form of a pole shaft construction according to the present invention, the hollow shaft includes at least one spiral winding layer in the shaft wall between the hollow bore and the outer surface of the shaft. The winding comprises a thin, widely-spaced winding of reinforcing filament such as glass. This thin winding serves to maintain the cylindrical shape of the shaft and its hollow bore during the reforming taper step, thereby preventing eccentricity and irregularity in the cross section of the shaft. It is even more advantageous to use at least two such windings, an inner winding near the hollow bore in the shaft wall, and a second winding spaced radially outwardly from the first winding between the first winding and the outer surface of the shaft. The two windings are wound in opposite directions, which improves the shape-holding characteristics and concentricity of the pole shaft.

In yet a further embodiment of the invention, a thin layer of anti-splinter polymer is extruded on the outer surface of the shaft as it is pultruded out the pultrusion die.

These and other features and advantages of the invention will become apparent upon further reading of the specification.

DETAILED DESCRIPTION OF THE DRAWINGS

Figures 1, 2, 3, 4, 5:
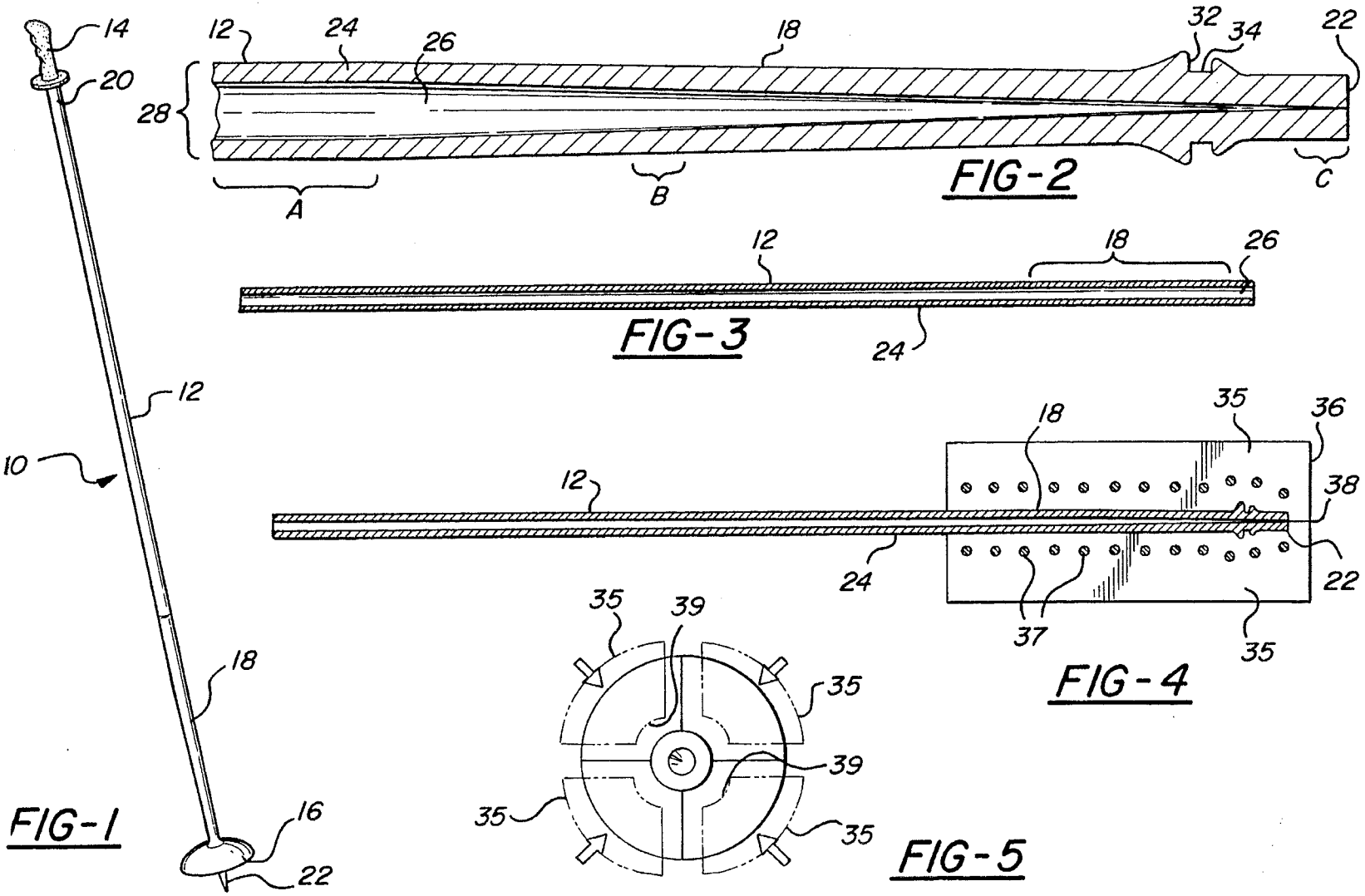
FIG. 1 is a full-length perspective view of a finished ski pole utilizing a tapered shaft according to the present invention.
FIG. 2 is a side cross-section view of the lower end of a ski pole shaft according to the present invention.
FIG. 3 is a side cross-section view of a straight, hollow, unformed ski pole shaft according to the present invention, prior to having a taper formed in the lower end.
FIG. 4 is a side-section view of the shaft of FIG. 3 as it is formed into its final shape in a schematically illustrated heating/molding die.
FIG. 5 is an end view of the clamping components of the die of FIG. 4 in relation to the ski pole shaft.

Referring to FIG. 1, an assembled ski pole 10 is shown having a tapered thermoplastic fiber/resin composite shaft 12, a grip 14 mounted on upper end 20 of the shaft, and a basket 16 mounted on lower end 18 of the shaft near tip 22. The fiber/resin composite structure of shaft 12 may take a variety of forms. Several particularly advantageous fiber/resin composite ski pole shaft structures are disclosed in my U.S. Pat. No. 5,024,866 and my co-pending application Ser. Nos. 826,734, 562,317 and 863,334. It should be understood, however, that the present inventive structure and method lends itself to many thermoplastic fiber/resin composite shaft constructions.

FIG. 2 shows lower end 18 of shaft 12 in cross-section. This is one embodiment of a finished ski pole shaft according to the present invention in which lower end 18 has been reformed from a straight, uniform wall thickness shaft as shown in FIG. 3 described below. Lower end 18 of the finished shaft 12 includes a shaft wall 24 of a thermoplastic fiber/resin composite material, the thermoplastic resin matrix made from any of a number of suitable, known, currently available materials such as, but not limited to, polyethylene, ABS, polypropylene, PEEK or Monsanto's nylon-based thermoplastic composite resin system Forlon®. PEEK and Monsanto's Forlon® are preferred, with PEEK providing optimum physical characteristics and Forlon® comparable but substantially less expensive. However, it is to be understood that the invention is not any particular thermoplastic, but rather the use of a suitable thermoplastic material in a ski pole shaft to permit its reformation into a finished product as described below.

It will be apparent to those skilled in the art of fiber/resin composite ski pole construction and thermoplastic resins that a wide variety of thermoplastic resins are available and suitable for use in the structure and method of the present invention. Most important is that the thermoplastic resin chosen, when in its hardened state, exhibit a suitable tensile strength and flexural modulus to permit its use in a ski pole shaft subject to the various stresses and bending forces associated with skiing. For example, it is preferred that the thermoplastic resin, in combination with the fibers in the composite structure, achieve a tensile strength on the order of 100,000 psi or higher, and have a flexural modulus on the order of 15–50 million psi. These are preferred ranges only, and for certain skiing applications it may be desirable to go higher or lower by modifying or substituting the thermoplastic resin used.

Still referring to FIG. 2, it is clear that the dimensions of shaft wall 24 and hollow bore 26 are altered at the lower end 18 and toward tip 22 of shaft 12. Looking at the uppermost end of lower end 18 (leftmost in FIG. 2) the outer diameter 28 at point A of shaft 12 in the illustrated embodiment measures approximately 0.50 inches; this is the outer diameter of upper shaft 18 as well. The inner diameter 30 at point A is approximately 0.33 inches, while the wall thickness is approximately 0.085 inches. These dimensions are for purposes of the illustrated embodiment only, and may be altered as desired to achieve particular weight and strength ratios in the ski pole shaft. The outer diameter at midpoint B of lower end 18 of shaft 12 is approximately 0.4375 inches, while the inner diameter is approximately 0.2245 inches and the wall thickness is approximately 0.1065 inches. At point C, and immediately adjacent tip 22, the outer diameter has been reduced to approximately 0.33 inches and the hollow bore 26 has been eliminated to produce a solid end. It is apparent, then, in tapered lower end 18 of shaft 12, that as the outer and inner diameters 28 and 30 decrease toward tip 22, the wall thickness increases until it approaches or achieves unity with the outer diameter.

It is important to note that the tapered shaft is an integral unit; that is, the shaft wall 24 is continuous throughout the ski pole shaft. It will be apparent to those skilled in the art that the steadily increasing wall thickness toward the tip of the pole at lower end 18 results in greatly increased strength, stiffness and crushing or breaking resistance where it is needed most.

Also shown in FIG. 2, integrally molded with shaft wall 24 near tip 22, is a basket receiving collar 32 including an annular groove 34 onto which basket 16 can be snapped or otherwise fastened.

It is not necessary for tip 22 to be solid; for example, the taper of lower end 18 toward tip 22 can be reduced to leave hollow bore 26 open at the tip. This may facilitate the addition of tip inserts should such be desired.

Referring now to FIGS. 3–5, one embodiment of an apparatus and method for making the tapered thermoplastic ski pole shaft of FIGS. 1 and 2 is illustrated. First a straight, untapered, cylindrical hollow shaft 12 is formed from a suitable thermoplastic fiber/resin composite. As shown in FIG. 3, the dimensions of shaft 12 at this point in the manufacturing process are uniform. Lower end 18 as yet has no taper or increase in wall thickness.

Figure 3A:
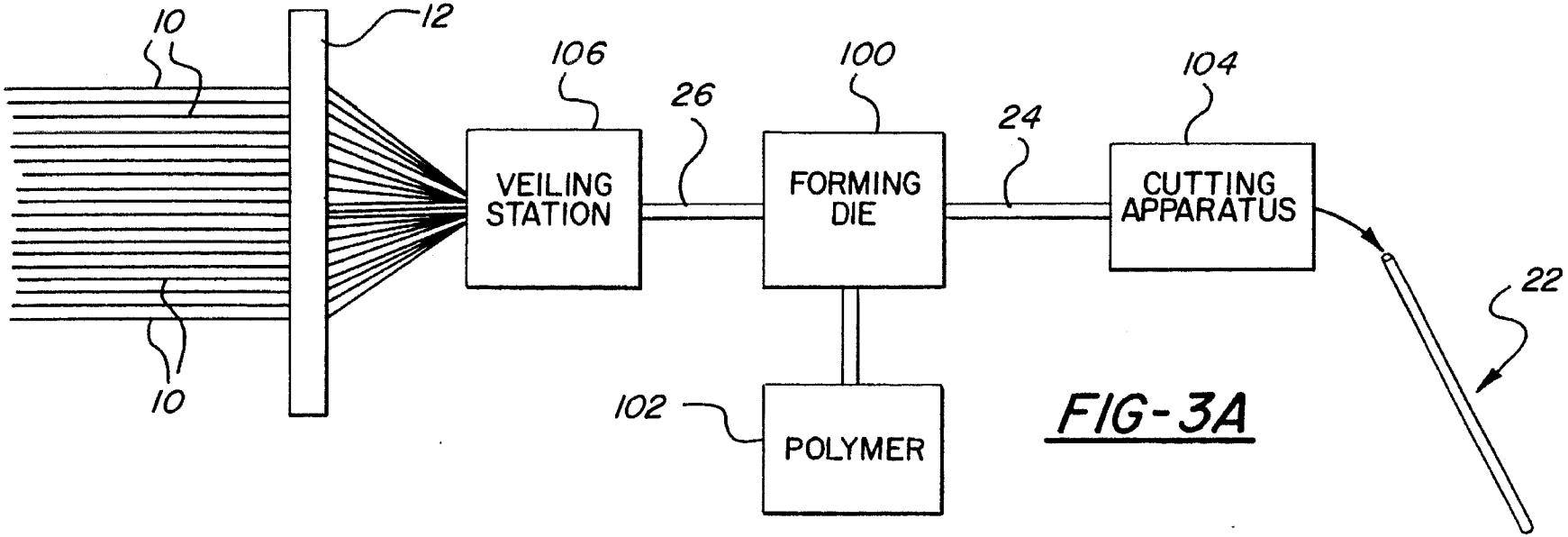
FIG. 3A is a schematic representation of one method of forming the shaft of FIG. 3.

In FIG. 3A, the process for making a ski pole according to FIG. 3 is shown in schematic form. An array of continuous reinforcing filaments 10 is pultruded from a suitable filament supply. As previously indicated, the filaments may comprise glass, carbon, aramid or any other filament material, including any combination of filament materials arranged in any suitable pattern or array compatible with this process. The array of filaments 10 is pultruded through a suitable guide member 12, which channels the filaments 10 into a forming die 100. Thermoplastic polymeric material 102 is heated to a liquid state and is injected into the forming die 100. The thermoplastic polymeric material 102 when injected into the forming die 100 coats and surrounds the filaments 100. The thermoplastic polymer material is cooled and hardened within the forming die 100 forming a continuously pultruded ski pole shaft 22 which is then cut into lengths suitable for use as ski poles by cutting apparatus 104.

An anti-splinter means, such as a polyester veil or an anti-splinter polymer sheath, may be added to the filaments 10 in a veiling station 106 prior to entering the forming die 100. A logo or design may be applied to the veil and the thermoplastic material chosen so that the design or logo is visible through the thermoplastic material.

The fiber/resin composite structure of hollow shaft 12 can take a variety of forms as long as it lends itself to suitable reheating and reforming and results in a pole with suitable strength and flexural modulus. In the illustrated embodiment the shaft wall has a fiber/resin ratio of approximately 4:1, the fibers running longitudinally along the length of the shaft in essentially parallel fashion. This 4:1 ratio has been found to be desirable for the tapering methods discussed below. The fibers can comprise glass, carbon, Kevlar or other suitable reinforcing fibers.

Figure 6:
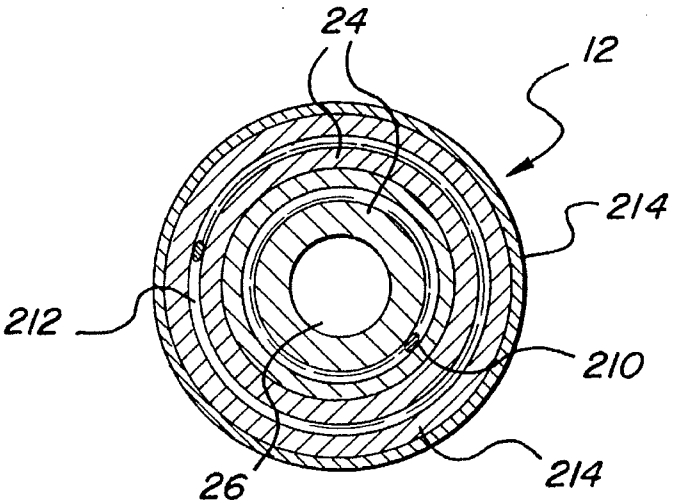
FIG. 6 is a cross-section view of a thermoplastic ski pole construction for use with the method of the present invention.
Figure 7:
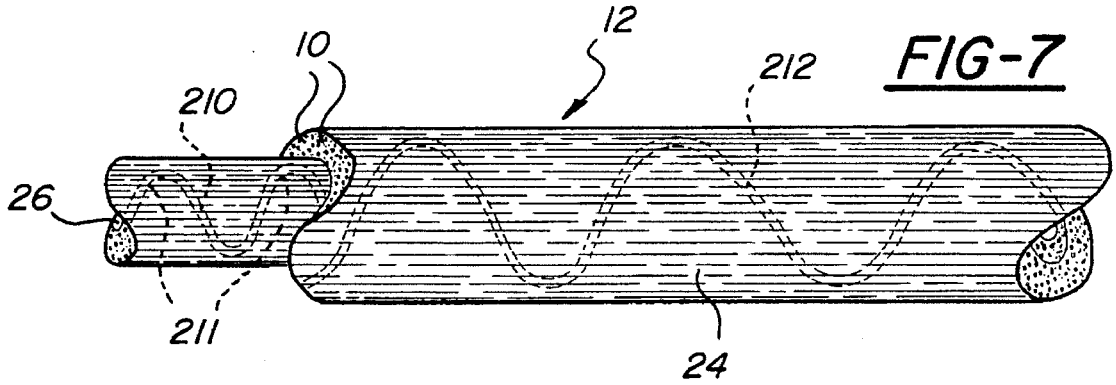
FIG. 7 is a side cross-section view of the shaft of FIG. 6.

Referring now to FIG. 6, a particularly advantageous structure for hollow shaft 12 of FIG. 3 is shown in cross section. In this preferred form, hollow shaft 12 includes at least one spiral or helical winding 210 of reinforcing filaments forming a thin, shape-holding reinforcing layer in the shaft wall 24 between the hollow bore 26 and the outer surface. As shown in FIG. 7, each coil or spiral 211 of winding 210 is relatively widely spaced, in the illustrated embodiment on the order of 0.5", although those skilled in the art will recognize that the spacing can vary and still provide shape-holding. Wound reinforcing layer 210 provides a shape-holding function for the hollow cylindrical shaft 12 during its initial forming and during the subsequent reheating and tapering steps according to the present invention. This prevents shaft 12 from losing its cylindrical outer diameter or bore as it is alternately cooled and heated; without the reinforcing layer 210, the thermoplastic resin tends to lose its shape easily.

Referring again to FIG. 6, shaft 12 in the illustrated embodiment comprises two reinforcing winding layers, first inner winding layer 210 wound in a first direction, and second outer winding layer 212 wound in the opposite direction. This has been found to be optimal in maintaining the concentric shape of the cylindrical hollow shaft 12.

Also shown in FIG. 6, an anti-splinter polymer. sheath on the outer surface of shaft 12. Sheath 214 is preferably extruded onto hollow shaft 12 during the pultrusion forming process as it leaves the pultrusion die. In the illustrated embodiment, sheath 214 is approximately 2/10 of a mm in thickness although the thickness can be increased or decreased as desired. A preferable range is approximately 2/10 mm to 2 mm in thickness for sheath 214.

Referring now to FIG. 4, the preformed, straight, hollow thermoplastic shaft 12 is next inserted in a suitable heating/ reforming die 36. Those skilled in the art will be familiar with machines suitable for this purpose; i.e., machines for simultaneously heating and clamping/pressurizing the end of shaft 12. The schematically-drawn die 36 of FIG. 4 shows the basic structure including at least two die halves 35 provided with heating elements 37.

Reheating/reforming die 36 is used to reheat lower end 18 of shaft 12 to a temperature at which the thermoplastic used in the fiber/resin shaft wall becomes easily worked. For example, a shaft using Forlon® as the thermoplastic resin should be heated to a temperature of approximately 525° F. Once lower end 18 of the shaft has been heated via heating elements 37 and the thermoplastic is sufficiently workable, the uniform clamping pressure applied by die halves 35 about the periphery of lower end 18 squeezes it down to the desired taper.

It is important to note that die 36 is closed at end 38 adjacent tip 22. Along with the unheated remainder of the shaft, this ensures that as pressure is applied to heated end 18, the thermoplastic resin displaced from shaft wall 24 cannot move longitudinally in either direction to increase the length of the ski pole shaft. Instead, it is radially displaced such that the wall thickness of the shaft at lower end 18 is increased as the taper increases. By holding the length of shaft 12 constant during the reheating and reforming process, a taper and an increase in wall thickness in the taper portion are simultaneously achieved, without the need for additional forming steps.

As shown in FIG. 5, the reforming/reheating die 36 may take the form of a number of die sections 35, in this illustrated version four quarter sections, having bearing surfaces 39 which, when the die sections 35 are joined, form a cylindrical bearing surface. In this manner the lower end 18 of shaft 12 can be tapered in a single step to the final rounded taper shown in FIG. 1.

In an alternative embodiment, uniform, cylindrical clamping or tapering pressure can be applied to lower end 18 of shaft 12 in the reforming step by means of known "shrink tube" material which contracts when heated.

In an alternate embodiment (not illustrated), the final tapered shape of lower end 18 of shaft 12 is achieved in a two-step tapering process. The cross section of the reheating/reforming die comprises two die halves whose bearing surfaces, when mated, do not form a circular bearing surface as shown in FIG. 5, but rather a wedge- or elliptical-shaped bearing surface. Shaft 12 in this embodiment of the invention is first inserted in the die and reheated/reformed into a flattened, wedge-shaped tapered portion. The die halves are then opened, shaft 12 is rotated 90°, and the die halves are brought back together for a second and final tapering step to squeeze lower end 18 of shaft 12 into its final, essentially tubular tapered shaft as shown in FIG. 1.

In both the one- and two-step reheating/reforming processes described above, it is advantageous during the tapering step to simultaneously inject or otherwise add additional molten thermal plastic resin to lower end 18 of shaft 12 in the die. This can be accomplished by suitable injection channels or sprues within the die sections 35, as will be within the capabilities of those skilled in the art. With high fiber content pole shafts, the flow of molten or softened thermoplastic resin from the shaft wall to the hollow bore during the reforming process can result in insufficient resin to cover and bind the fibers at lower end 18 of the pole, resulting in "dry" fibers. Injection of additional resin during the reforming step solves this problem by keeping the fibers near the outer surface of the pole at lower end 18 suitably coated with resin. The additional resin also serves to maintain the temperature of the heated lower end of the pole, thereby keeping it sufficiently workable to ensure successful tapering.

It is particularly advantageous to inject the additional molten thermoplastic resin at a temperature higher than the working temperature of the resin in the shaft wall. Alternately, thermoplastic resin with a higher melting temperature can be used. For example, in one embodiment I use Monsanto's Forlon® with a working temperature of approximately 525° F. for the body of shaft 12, and inject molten nylon 6/6 at approximately 565° F. during the tapering step. The additionally injected resin can also be used to form an integral basket collar as described above, if desired.

Referring now to FIGS. 8–11, a further and preferred method and apparatus for achieving the tapered thermoplastic pole of the present invention is shown using a tapered mandrel 300 and a silicone rubber sleeve 302 sized to fit snugly over the lower end 18 of the hollow, cylindrical shaft 12 of FIG. 3.

Figure 8:
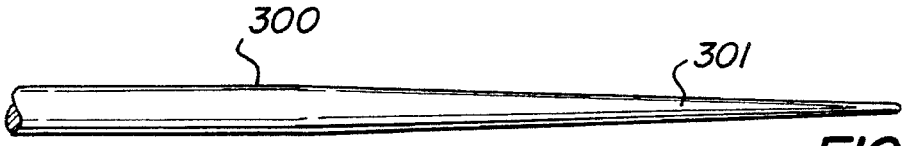
FIGS. 8–11 are schematic views of an alternate tapering method according to the present invention using a shrink tube and tapered mandrel.

Referring to FIG. 8, tapered mandrel 300 is inserted in the hollow, cylindrical bore 26 of ski pole shaft 12 as shown, the tapered end 301 of mandrel 300 concentric and aligned with the tip of the ski pole shaft at lower end 18. Mandrel 300 is of a diameter and taper matched to the desired dimensions of a finished, tapered thermoplastic ski pole bore according to the present invention.

Figure 9:
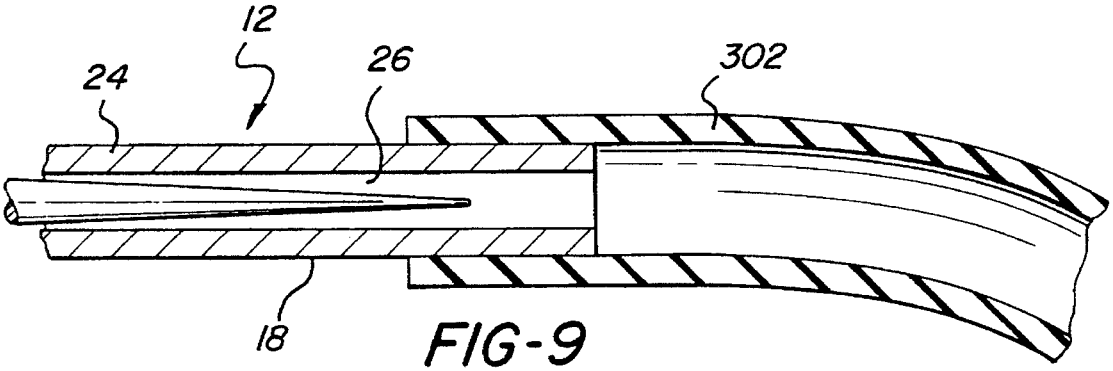

Referring to FIG. 9, a silicone rubber tube or sleeve 302 is pulled over lower end 18 of shaft 12 surrounding the tapered end portion 301 of mandrel 300. In the illustrated embodiment, the silicone rubber tube has an outer diameter of approximately 5/16 of an inch and a wall thickness of approximately 1/8 of an inch. Its elastic nature permits it to be fitted over the lower end 18 of shaft 12 in a conforming, essentially air-tight fit. It is desirable to smooth tube 302 to eliminate wrinkles and air spaces between the tube 302 and shaft 12 as shown in FIG. 10.

Figure 10:
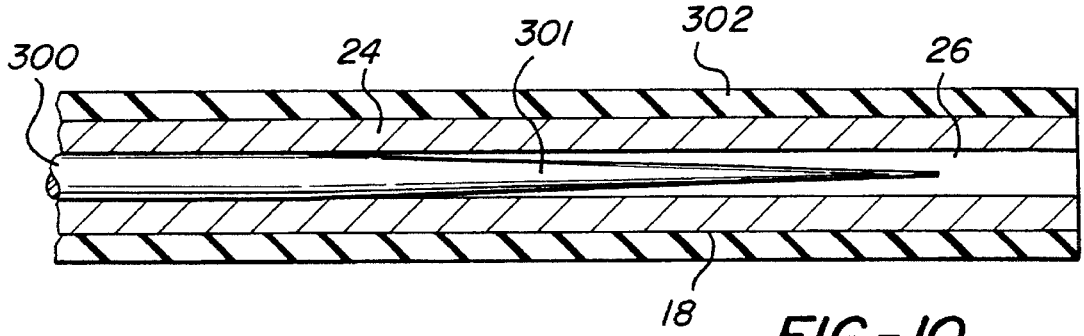

At this point, with the silicone rubber tube 302 positioned on lower end 18 as shown in FIG. 10, the thermoplastic ski pole shaft 12 has not yet been reheated and is in its manufactured, rigid form. Lower end 18 surrounding tapered mandrel 300 and surrounded by silicone tube 302 is then heated to approximately 500° Fahrenheit for 10 minutes. During this reheating process, the thermoplastic resin matrix in lower end 18 of shaft 12 is softened and subsequently squeezed down to conform to tapered end 301 of mandrel 300 by the force applied by silicone tube 302. Lower end 18 naturally follows the taper of mandrel 300.

Figure 11:
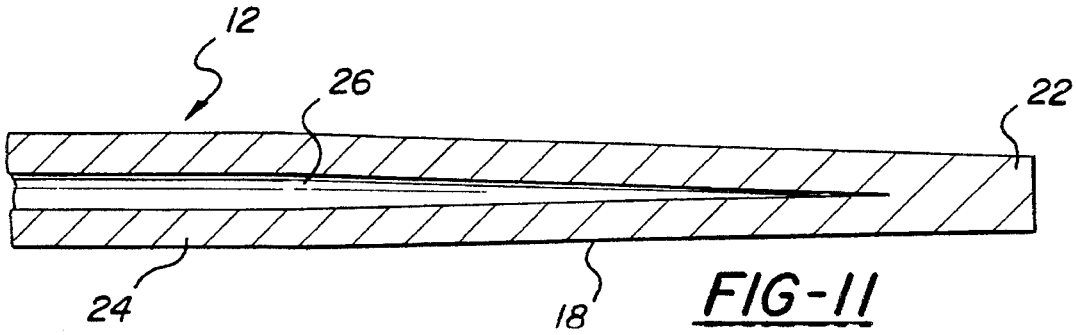

As shown in FIG. 11, lower end 18 of shaft 12 is subsequently cooled, the silicone tube 302 is removed and the mandrel 300 is withdrawn from hollow bore 26, leaving the finished, uniformly tapered end 18 exhibiting a gradually increasing wall thickness towards the tip 22.

In the method illustrated in FIGS. 8–11, it is not necessary to close off the end of sleeve 302 adjacent tip 22 of shaft 12 to produce the internal increase in wall thickness toward tip 22, because the taper of mandrel 300 provides an internal guide during the reforming process. This method is the simplest and least expensive method currently known to reform a previously-manufactured hollow, cylindrical thermoplastic ski pole with a tapered end.

It will be understood to those of skill in the art that the foregoing is an illustrated embodiment only, and is not intended to be limiting, as many modifications of the above-described structure and method can be made and still lie within the scope of the appended claims. It is believed that the method of tapering a straight-walled fiber/resin compound ski pole shaft by forming it of a thermoplastic material, and subsequently reheating and reforming at least the lower end thereof, is broadly patentable.

I claim:

1. A method for making a strong, lightweight, fiber/resin composite ski pole shaft with an internally-reinforced tapered lower end, comprising the steps of:

forming a fiber/resin composite ski pole shaft of a reformable thermoplastic material, the shaft having a hollow body with an upper end and a lower end;

heating the lower end of the shaft to a temperature at which the thermoplastic material becomes reformable; and applying external pressure to the heated lower end of the shaft to taper the lower end toward a tip.

2. A method for forming a ski pole shaft as defined in claim 1, further including the step of maintaining the shaft at constant length during the tapering step to increase the wall thickness of the shaft at the tapered lower end.

3. A method for forming a ski pole shaft as defined in claim 2 wherein the wall thickness is increased uniformly to a maximum at the tip.

4. A method for forming a ski pole shaft as defined in claim 3, wherein the wall thickness is increased at a rate such that the tip becomes solid.

5. A method for forming a ski pole shaft as defined in claim 1, wherein the tapering step includes forming an integral basket receiving portion in the lower end of the shaft.

6. A method for forming a ski pole shaft as defined in claim 1, wherein the tapering step comprises applying uniform external pressure about the periphery of the lower end of the shaft to taper the lower end in a single step.

7. A method for forming a ski pole shaft as defined in claim 1, wherein the tapering step consists of a sequence of steps which include applying external non-uniform pressure to the heated lower end of the shaft to provide a partial taper, rotating the shaft to a pre-selected angular orientation, and re-applying non-uniform external pressure to the partially tapered lower end to provide a final tapering.

8. A method for forming a strong, lightweight fiber/resin composite ski pole shaft with an internally-reinforced tapered lower end, comprising the steps of:

forming a cylindrical fiber/resin composite ski pole shaft of a reformable thermoplastic material, the shaft having a hollow body with an upper end, a lower end, and a cylindrical bore;

inserting a mandrel in the cylindrical bore of the ski pole shaft, the mandrel having a tapered lower end;

applying a tube of elastic, heat-resistant material over the lower end of the ski pole shaft corresponding to the tapered lower end of the mandrel;

subsequently heating the lower end of the ski pole shaft to a softened state such that the elastic tube exerts uniform, circumferential pressure on the lower end of the ski pole shaft to reform it about the tapered lower end of the mandrel; and subsequently removing the elastic tube from the tapered lower end of the ski pole shaft and removing the mandrel from the hollow bore of the shaft.

9. A method as defined in claim 8, wherein the lower end of the ski pole shaft, the mandrel and the elastic tube are inserted in a pressure vessel to additionally pressurize the heated lower end of the ski pole shaft and aid in the tapering process.

10. A fiber/resin composite ski pole shaft manufactured according to the method of claim 6, wherein the resin is a thermoplastic material, the shaft has a hollow body with an upper end and a lower end terminating in a tip, and the lower end includes a taper toward the tip and a wall thickness increasing toward a maximum thickness near the tip.

11. The ski pole as defined in claim 10, wherein the increased wall thickness at the tapered lower end is a continuous, integral extension of the wall of the shaft.

12. A ski pole shaft as defined in claim 11 wherein the wall thickness increases uniformly toward the tip.

13. A ski pole as defined in claim 12 wherein the wall thickness increases toward the tip such that it achieves unity with the outer diameter of the shaft to form a solid tip.

14. A ski pole shaft as defined in claim 10, wherein a basket receiving portion is integrally molded in the tapered lower end.

15. A method for making a strong, lightweight fiber/resin composite ski pole shaft with an internally-reinforced tapered lower end, comprising the steps of:

forming a fiber/resin composite ski pole shaft of a reformable thermoplastic material, the shaft having a hollow body with an upper end and a lower end, the fibers arranged longitudinally along the axis of the shaft, the shaft further including at least one spirally wound filament layer between the hollow bore and the outer surface of the shaft;

heating the lower end of the shaft of a temperature at which the thermoplastic material becomes reformable; and applying external pressure to the heated lower end of the shaft to taper the lower end toward a tip.

16. A method as defined in claim 15, wherein the step of forming a fiber/resin composite ski pole shaft further includes pultruding an array of fibers through a resin bath about a mandrel.

17. A method for making a strong, lightweight fiber/resin composite ski pole shaft with an internally-reinforced tapered lower end, comprising the steps of:

forming a fiber/resin composite ski pole shaft of a reformable thermoplastic material, the shaft having a hollow body with an upper end and a lower end, the fibers arranged longitudinally along the axis of the shaft, the shaft further including at least one spirally wound filament layer between the hollow bore and the outer surface of the shaft;

heating the lower end of the shaft to a temperature at which the thermoplastic material becomes reformable;

applying external pressure to the heated lower end of the shaft to taper the lower end toward a tip;

wherein the step of forming the fiber/resin composite ski pole shaft includes forming a second spirally wound filament layer between the first spirally wound filament layer and the outer surface of the shaft, the second spirally wound filament layer wound in a direction opposite that of the first spirally wound filament layer.

18. A method for making a strong, lightweight fiber/resin composite ski pole shaft with an internally-reinforced tapered lower end, comprising the steps of:

forming a fiber/resin composite ski pole shaft of a reformably thermoplastic material, the shaft having a hollow body with an upper end and a lower end, the fibers arranged longitudinally along the axis of the shaft, the shaft further including at least one helically wound layer of fibers between the hollow bore and the outer surface of the shaft;

heating and lower end of the shaft to a temperature at which the thermoplastic material becomes reformable;

applying external pressure to the heated lower end of the shaft to taper the lower end toward a tip;

wherein the step of forming the fiber/resin composite ski pole shaft further includes pultruding an array of fibers through a resin bath about a mandrel;

and extruding a layer of polymeric material on the surface of the shaft as it is pultruded to provide an anti-splinter layer.

19. A method for making a strong, lightweight, fiber/resin composite ski pole shaft with an internally-reinforced tapered lower end, comprising the steps of:

forming a fiber/resin composite ski pole shaft of a reformable thermoplastic material, the shaft having a hollow body with an upper end and a lower end;

heating the lower end of the shaft to a temperature at which the thermoplastic material becomes reformable;

applying external pressure to the heated lower end of the shaft to taper the lower end toward a tip;

wherein the tapering step includes applying additional thermoplastic resin to the heated lower end of the shaft not later than simultaneous with the application of external pressure.

20. A method as defined in claim 19, wherein the step of applying additional thermoplastic resin includes applying the resin at a temperature higher than the temperature at which the resin becomes reformable.

21. A method as defined in claim 18, wherein the step of applying additional thermoplastic resin includes applying a different thermoplastic resin having a higher melting temperature than the temperature of the resin forming the heated lower end.

22. A method for making a strong, lightweight, fiber/resin composite ski pole shaft with an internally-reinforced tapered lower end, comprising the steps of:

forming a fiber/resin composite ski pole shaft of a reformable thermoplastic material, the shaft having a hollow body with an upper end and a lower end;

heating the lower end of the shaft to a temperature at which the thermoplastic material becomes reformable; and applying external pressure to the heated lower end of the shaft to taper the lower end toward a tip;

wherein the tapering step includes placing the lower end of the shaft in a reheating/reforming die, the die having a closed end adjacent the tip of the lower end of the ski pole shaft to maintain the ski pole at a constant length as the lower end is reheated and reformed within the die.

23. A method for making a strong, lightweight, fiber/resin composite ski pole shaft with an internally-reinforced tapered lower end, comprising the steps of:

forming a fiber/resin composite ski pole shaft of a reformable thermoplastic material, the shaft comprising a hollow cylindrical body having an upper end, a lower end, and a bore opening onto both ends;

heating the lower end of the shaft to a temperature at which the thermoplastic material becomes reformable; and applying external pressure to the heated lower end of the shaft to taper the lower end toward a tip;

wherein the step of tapering the lower end of the shaft toward the tip includes the step of simultaneously increasing the wall thickness of the lower end toward a maximum thickness near the tip.

24. A method according to claim 23, wherein the step of tapering the lower end toward the tip includes the step of closing the bore at the lower end.

* * * * *

UNITED STATES PATENT AND TRADEMARK OFFICE

CERTIFICATE OF CORRECTION

PATENT NO. : 5,503,432

DATED : April 2, 1996

INVENTOR(S) : Goode

It is certified that error appears in the above-indentified patent and that said Letters Patent is hereby corrected as shown below:

Column 6, line 58, delete "polymer.sheath" and insert --polymer sheath--.

Signed and Sealed this

Seventh Day of January, 1997

*Attest:*

BRUCE LEHMAN

*Attesting Officer*

*Commissioner of Patents and Trademarks*